United States Patent [19]

Wade

[11] Patent Number: 4,984,329

[45] Date of Patent: Jan. 15, 1991

[54] DUCT SWEEPER

[75] Inventor: Calvin N. Wade, Hico, Tex.

[73] Assignee: Steamatic, Inc., Grand Prairie, Tex.

[21] Appl. No.: 407,348

[22] Filed: Sep. 14, 1989

[51] Int. Cl.[5] ..... A47L 9/02

[52] U.S. Cl. ..... 15/387; 15/395

[58] Field of Search ..... 15/387, 395

[56] References Cited

U.S. PATENT DOCUMENTS

| | | | |
|---|---|---|---|
| 1,580,294 | 4/1926 | Gawley | 15/387 X |
| 2,078,634 | 4/1937 | Karlstrom | 15/387 X |
| 2,351,169 | 6/1944 | Weinland | 15/387 X |
| 4,792,363 | 12/1988 | Franklin et al. | 15/395 X |
| 4,800,616 | 1/1989 | Wade | 15/387 X |

FOREIGN PATENT DOCUMENTS

| | | | |
|---|---|---|---|
| 2064410 | 7/1971 | Fed. Rep. of Germany | 15/387 |
| 340683 | 5/1904 | France | 15/387 |
| 1062393 | 3/1967 | United Kingdom | 15/395 |

*Primary Examiner*—Chris K. Moore
*Attorney, Agent, or Firm*—Arthur F. Zobal

[57] ABSTRACT

The cleaning apparatus is formed by a housing member having a first flexible hose coupled to a first end and a smaller diameter second flexible hose coupled to a second opposite end. A turbine is supported for rotation within the housing member. A flexible drive shaft extends through the second flexible hose and has one end coupled to the turbine for rotation therewith and a second end extending out of the other end of the second flexible hose with a brush coupled thereto. An air blower, which preferably is operated in the vacuum mode, is coupled to the first flexible hose for moving air through the second flexible hose, the housing member, and the first flexible hose for causing the turbine and hence the flexible drive shaft and brush to rotate for cleaning the wall of an air duct with the brush and for removing dust and other matter from the duct.

5 Claims, 2 Drawing Sheets

DUCT SWEEPER

BACKGROUND OF THE INVENTION

1. Field of the Invention

The invention relates to a cleaning apparatus for cleaning air ducts in houses or buildings.

2. Description of the Prior Art

U.S. Pat. Nos. 1580294, 2078634, and 4800616 disclose air powered cleaning devices comprising a hose having a turbine attached thereto which is rotated by air for rotating a brush or other device for cleaning purposes.

SUMMARY OF THE INVENTION

It is an object of the invention to provide a cleaning apparatus which allows the thorough, yet gentle cleaning of small and/or fragile ducts in homes or buildings.

The apparatus comprises a housing supporting a turbine, a first flexible hose means having an end coupled to one end of the housing, and a second flexible hose means, having an end coupled to the other end of the housing. A flexible drive shaft has one end coupled to the turbine. The drive shaft extends through the second end of the flexible hose means and its other end has a brush connected thereto. The second flexible hose means and its brush are adapted to be located in an air duct for cleaning purposes. An air blower is coupled to the other end of the first hose means for causing air to flow through the second hose means, the housing, and the first hose means for causing the turbine and hence the flexible drive shaft and brush to rotate for cleaning purposes In the preferred embodiment, the second hose means is smaller in cross-section than that of the first hose means. In addition the air blower is operated to reduce the pressure in the hoses and housing to remove dust and other material loosened in the air duct by the brush.

DETAILED DESCRIPTION OF THE PREFERRED EMBODIMENTS

Figure 1:
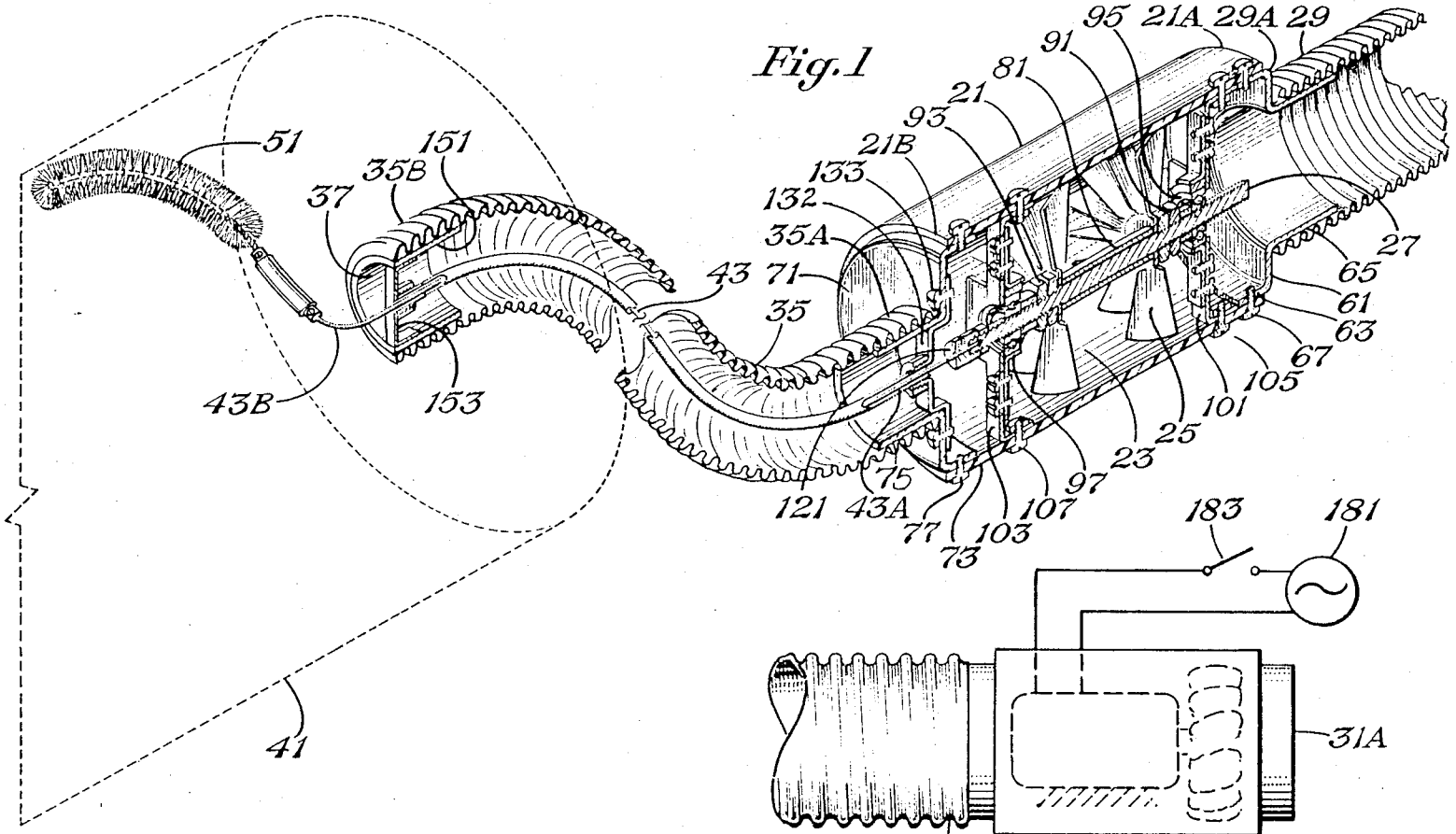
FIG. 1 is a cross-sectional view of components of the invention.
Figure 2:
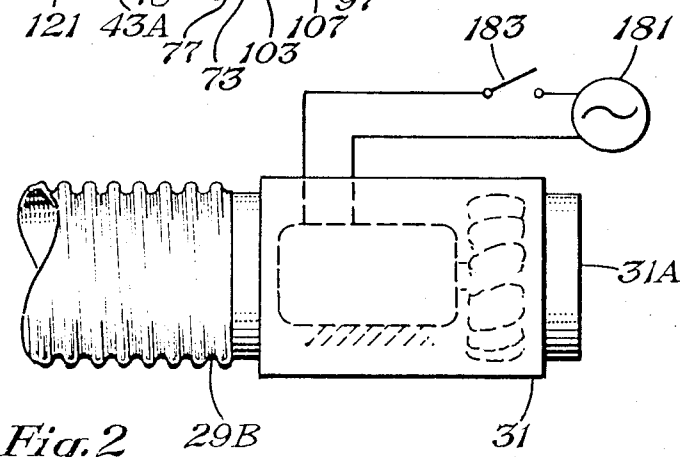
FIG. 2 illustrates a blower coupled to the larger hose of the apparatus of FIG. 1.

Referring to the drawings, the cleaning apparatus of the invention comprises a housing 21 which supports a turbine 23 for rotation. The turbine 23 comprises blades 25 attached to a shaft 27 which are supported for rotation in the housing 21. A flexible hose 29 has an end 29A coupled to the end 21A of the housing 21 and an end 29B coupled to a blower 31. A smaller diameter flexible hose 35 has an end 35A coupled to the end 21B of the housing 21 and a free end 35B adapted to be located in an air duct 41 for cleaning purposes. A flexible drive shaft 43 has an end 43A connected to the drive shaft 27 a rotation therewith The drive shaft 43 extends through the hose 35 and projects beyond its free end 35B. A brush 51 is connected to the free end 43B of the drive shaft. In the preferred operation, the end 35B of the smaller diameter hose 35 and the brush 51 are inserted into the conduit 41 and the blower 31 is operated as a vacuum blower to move air from the air duct 41 by way of a flow path through the flexible hose 35, the housing 21, and the flexible hose 29. This causes the turbine 23 to rotate which in turn causes the flexible drive shaft 43 and the brush 51 to rotate. Rotations of the brush 51 in the air duct 41 causes the brush 51 to move outward by centrifugal force to make contact with all sides of the duct 41 to loosen matter and dust from the inside wall of the air duct 41. The loosened material is removed by the vacuum and out of the exit 31A of the blower 31 by way of the entrance 37 to the flexible hose 35, through the flexible hose 35, through the housing 21, and through the flexible hose 29. Thus the brush 51 is driven by the turbine 23 that is powered by the vacuum. Rotary power is transmitted by the flexible drive shaft 43 between the turbine 23 and the brush 51. This system allows the thorough, yet gentle cleaning of small and/or fragile ducts. Since the flexible hose 35 is small in diameter, it may be readily inserted into small air ducts or into small register or vent openings into an air duct and moved into the air duct for cleaning purposes by operating the blower for rotating the turbine and hence the flexible drive 43 and the brush 51. The flexible hose 35 can readily turn elbows in the air duct 41 and the brush 51 in effect sweeps the inside of the walls of the duct 41 without any damage occurring there too.

In the embodiment disclosed, the housing 21 comprises a hollow cylindrical member having two end walls 61 and 71. End wall 61 joins two tubular portions 63 and 65 of greater and smaller diameters respectively. Tubular portion 63 fits inside of the housing end 21A and is secured thereto by bolts 67. The end 29A of flexible hose 21 tightly fits around tubular portion 63 End wall 71 points two tubular portions 73 and 75 of greater and smaller diameters respectively. Tubular portion 73 fits inside of the housing end 21B and is secured thereto by bolts 77. The end 35A of hose 35 tightly fits around tubular portion 75.

The turbine 23 comprises two sets of blades or vanes 25 secured to a tubular member 81 which is secured to the shaft 27 by nuts 91 and 93 for rotation therewith. The shaft 27 is supported for rotation inside of the housing 21 by bearings 95 and 97 which are supported by support members 101 and 103 which are secured to the inside of the housing 21 by bolts 105 and 107.

Figure 3:
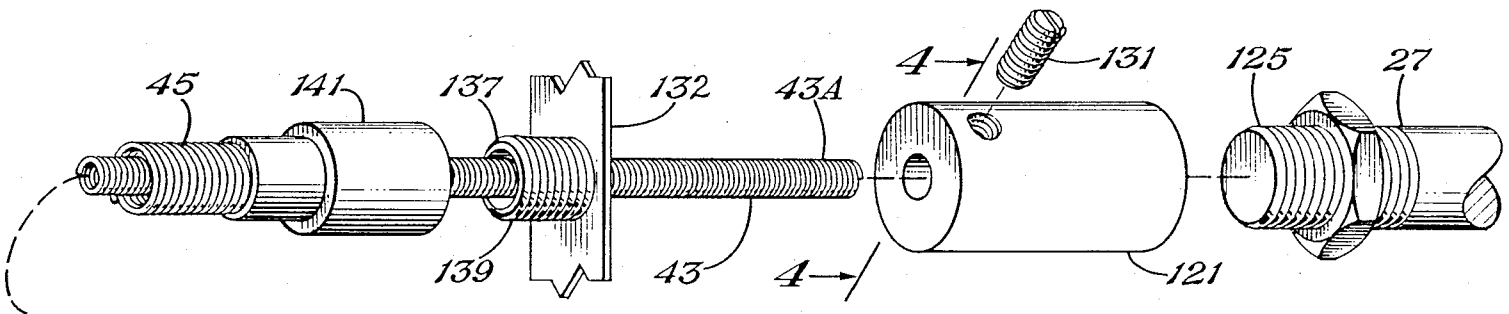
FIG. 3 is an exploded view of the mechanism for coupling the flexible drive shaft and its sleeve to the turbine shaft and to structure of the apparatus of FIG. 1.
Figure 3:
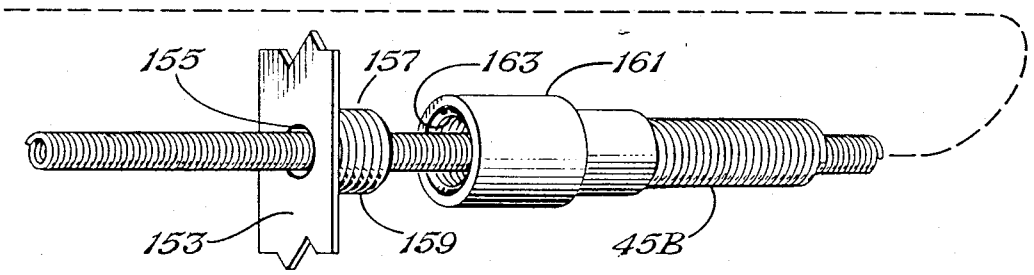
Figure 4:
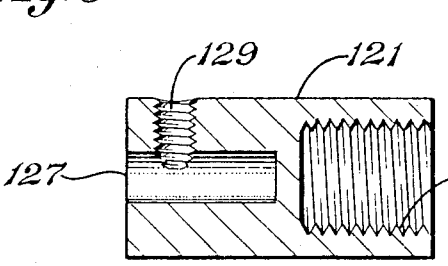
FIG. 4 is a cross-sectional view of a coupling means of FIG. 3 for coupling the flexible drive shaft to the turbine shaft.
Figure 5:
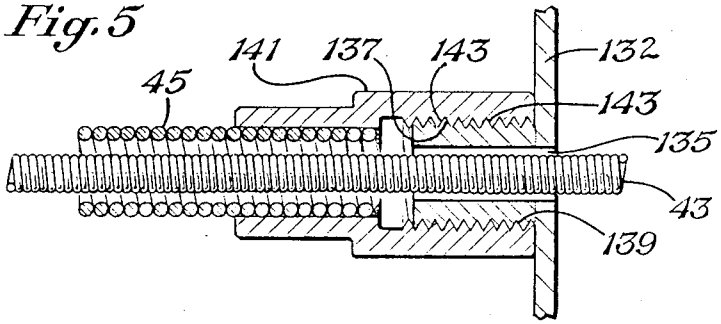
FIG. 5 is a cross-sectional view of a coupling means of FIG. 3 for coupling the flexible drive shaft sleeve to structure of the turbine housing.

The flexible drive shaft 43 is secured to the shaft 27 by a coupling member 121. As shown in FIGS. 3 and 4, coupling member 121 has a threaded aperture 123 formed at one end which is screwed to threads 125 formed on the end of shaft 27. The other end of the couping member 121 has a central aperture 127 for receiving the end 43A of the flexible drive shaft 43 and a threaded hole 129 in which a set screw 131 is screwed for securing the drive shaft 43 to the coupling member 121 for rotation with the turbine shaft 27.

The flexible drive shaft 43 has an outer flexible sleeve 45 which has an end 45A that is coupled to the end wall 71 in a manner to prevent rotation of the sleeve 45. A support member 132 is secured to the end wall 71 by bolts 133. The support member 132 has an aperture 135 formed therethrough for freely receiving the flexible drive shaft 43. A tubular member 137 is secured to the outside of the support member 131 around the aperture 135 for freely receiving the flexible drive shaft 43. Threads 139 are formed on the outside of tubular member 137. The end 45A of the flexible sleeve 45 is fixedly secured to a tubular member 141 which has a threaded aperture 143 at an end thereof which is screwed to the tubular member 137.

The free end 35B of the flexible hose 35 has a tubular member 151 fitted on the inside thereof to which a support member 153 is secured by bolts (not shown). The support member 153 has an aperture 155 formed therethrough for freely receiving the end 43B of the flexible drive shaft 43. A tubular member 157 is secured to the inside of the support member 153 around the aperture 155 for freely receiving the end 43B of the flexible drive shaft 43. Threads 159 are formed on the outside of the tubular member 157. The end 45B of the flexible sleeve 45 is fixedly secured to a tubular member 161 which has a threaded opening 163 formed at an end thereof which is screwed to the tubular member 157. The tubular member 161 freely receives the end 43B of the flexible drive shaft 43.

In one embodiment, the housing member 21 may have an outside diameter of about 3¼ inches and a length of about (6 inches). The walls 21, 61 and 71 of the housing member 21 may be formed of metal or suitable plastic. The components of the turbine 23 may be formed of metal. The flexible hoses 29 and 35 may be conventional flexible hose formed of corrugated flexible plastic in which is embedded a helically coiled wire for support purposes. Hose 29 may have an inside diameter of 2 inches and a length of 50–150 feet. The hose 35 may have an inside diameter of 1½ inches and a length of 10–15 feet. The flexible drive shaft 43 and its outer sleeves 45 may be a conventional flexible drive shaft assembly formed of suitable coiled wires.

The flexible hose 35 may be used to clean round or even square ducts into which the housing 21 and hose 29 cannot fit. A conventional round duct which may be cleaned with the apparatus may have an inside diameter of from 2 to 10 inches. Due to the elbows such a duct may have, the housing 21 may not pass therethrough, however, since the hose 35 has essentially no rigid restrictions and is flexible between its ends 35B and 35A, it can readily pass all elbows of the air duct. The length of the tubular member 151 can be made shorter than that shown, if desired, in order to minimize it affect on the flexibility of the hose 35 at the hose end 35B. The hose 35 also can readily pass through small register or vent openings. The hose 35 and brush 51 also can be used to affectively clean fragile air ducts without damage to the duct. Such fragile air ducts now on the market comprise a plastic inner liner with insulation on the outside.

It is desirable that the hose 29 have a relatively large inside diameter in order to minimize the air resistance to obtain a high turbine rpm.

The vacuum blower 31 may comprise plurality of electric motors having a total house power of 7½ capable of drawing 40 amps and with fan blades capable of moving 300 cfm of air. The electric motors are operated from an AC power source 181 when the switch 183 is closed. The blower 31 may be operated as a vacuum blower or reversed to blow air through hose 29 housing 21 and hose 35. The blower 31 is not shown to scale and will be much larger than shown compared to the diameters of hose 29 and housing member 21. It is to be understood that the apparatus of the invention may have other dimensions and operating specifications.

I claim:

1. A cleaning apparatus, comprising:

a housing means having first and second spaced apart ends, a first flexible hose means having first and second ends with said second end being coupled to said first end of said housing means, a second flexible hose means having first and second ends with its said first end being coupled to said second end of said housing means, said second flexible hose means being insertable into a duct for cleaning purposes.

said second flexible hose means, said housing means, and said first flexible hose means providing a flow path for the flow of air between said second end of said second flexible hose means and said first end of said first flexible hose means, turbine means supported within said housing means for rotation about an axis upon the passage of air through said housing means by way of said flow path, a flexible drive shaft extending through said second flexible air hose means and having a first end coupled to said turbine means and a second end extending out of said second end of said second flexible hose means for rotation with said turbine means, and, brush means coupled to said second end of said flexible drive shaft for rotation therewith for cleaning the wall of said air duct upon rotation of said flexible drive shaft.

2. The cleaning apparatus of claim 1, comprising:

air blower means coupled to said first end of said second flexible house means for causing air flow through said housing means by way of said flow path for causing said turbine means to rotate.

3. The cleaning apparatus of claim 1, wherein:

said second flexible hose means has a cross sectional interior size smaller than that of said housing means and smaller than that of said first flexible hose means.

4. The cleaning apparatus of claim 1, comprising:

air blower means coupled to said first end of said first flexible hose means for reducing the pressure within said first flexible hose means, said housing means, and said second flexible hose means for causing air to flow through said housing means by way of said second end of said second flexible hose means and said first end of said first flexible hose means for causing said turbine means and hence said flexible drive shaft and said brush means to rotate and for removing matter loosened in said air duct by said brush means.

5. The cleaning apparatus of claim 4, wherein:

said second flexible hose means has a cross sectional interior size smaller than that of said housing means and smaller than that of said first flexible hose means.

* * * * *